US012221798B2

(12) United States Patent
Zhang et al.

(10) Patent No.: US 12,221,798 B2
(45) Date of Patent: Feb. 11, 2025

(54) SCAFFOLD ANTI-FALLING DEVICE

(71) Applicant: CHENGDU JUSTREACH SCIENCE & TECHNOLOGY CO., LTD., Chengdu (CN)

(72) Inventors: Shuai Zhang, Chengdu (CN); Hong Qi, Chengdu (CN); Dexue Chen, Chengdu (CN)

(73) Assignee: CHENGDU JUSTREACH SCIENCE & TECHNOLOGY CO., LTD., Chengdu (CN)

( * ) Notice: Subject to any disclaimer, the term of this patent is extended or adjusted under 35 U.S.C. 154(b) by 934 days.

(21) Appl. No.: 17/295,532

(22) PCT Filed: Mar. 28, 2019

(86) PCT No.: PCT/CN2019/079977
§ 371 (c)(1),
(2) Date: Jun. 24, 2021

(87) PCT Pub. No.: WO2020/103368
PCT Pub. Date: May 28, 2020

(65) Prior Publication Data

US 2022/0018144 A1 Jan. 20, 2022

(30) Foreign Application Priority Data

Nov. 23, 2018 (CN) ..... 201811412974.5

(51) Int. Cl.
*E04G 5/00* (2006.01)

(52) U.S. Cl.
CPC ..... *E04G 5/001* (2013.01)

(58) Field of Classification Search
CPC .. E04G 5/001; E04G 3/28; E04G 3/32; E04G 21/3204; E04G 21/3219; E04G 21/3247; E06C 7/187
(Continued)

(56) References Cited

U.S. PATENT DOCUMENTS 6,962,234 B1 * 11/2005 Reeves ..... E04G 21/3261 182/36
7,513,480 B2 * 4/2009 Bergaretxe ..... E04G 11/28 249/20
(Continued)

FOREIGN PATENT DOCUMENTS

CN 203924665 U * 11/2014
CN 204299149 U 4/2015
(Continued)

*Primary Examiner* — Colleen M Chavchavadze
(74) *Attorney, Agent, or Firm* — Bayramoglu Law Offices LLC

(57) ABSTRACT

A scaffold anti-falling device including a base body. A mounting shaft and a limiting block are fixed in the base body, and an anti-falling retaining arm is movably installed on the mounting shaft. A tail end of the anti-falling retaining arm corresponds to the limiting block, and the anti-falling retaining arm is limited by the limiting block when the anti-falling retaining arm is placed flat. A counterweight block is installed on the tail end of the anti-falling retaining arm, and the counterweight block drives to the anti-falling retaining arm to swing upward to reset. A trigger swing arm is movably installed in the base body, and the trigger swing arm is placed under the anti-falling retaining arm and forms an angle with the anti-falling retaining arm. The scaffold anti-falling device is simple in structure and convenient in installation and can effectively prevent a scaffold from falling accidentally.

5 Claims, 4 Drawing Sheets

(58) Field of Classification Search
USPC ..... 182/112
See application file for complete search history.

(56) References Cited

U.S. PATENT DOCUMENTS

| | | | | |
|---|---|---|---|---|
| 8,708,100 | B2 * | 4/2014 | Schwoerer | E04G 11/28 182/20 |
| 10,036,170 | B2 * | 7/2018 | Panseri | E04G 11/28 |
| 10,479,656 | B2 * | 11/2019 | Carmel | B66C 23/78 |
| 10,711,470 | B2 * | 7/2020 | Vogl | E04G 11/32 |
| 11,608,649 | B2 * | 3/2023 | Hammond | B66F 17/006 |
| 11,655,640 | B2 * | 5/2023 | Abadia Perez | E04G 11/28 182/36 |
| 2006/0054388 | A1 * | 3/2006 | Reeves | E04G 21/3261 182/3 |
| 2015/0129359 | A1 * | 5/2015 | Urzelai Ezkibel | E04G 3/20 182/82 |
| 2015/0167326 | A1 * | 6/2015 | Shen | E04G 3/32 182/141 |
| 2019/0071884 | A1 * | 3/2019 | Aranburu Etxezarreta | E04G 3/20 |
| 2023/0228108 | A1 * | 7/2023 | MacKarvich | E04G 21/3233 256/59 |

FOREIGN PATENT DOCUMENTS

| | | | | | |
|---|---|---|---|---|---|
| CN | 105040964 | A | | 11/2015 | |
| CN | 105298101 | A | | 2/2016 | |
| CN | 205591532 | U | | 9/2016 | |
| CN | 106836781 | A | * | 6/2017 | E04G 5/001 |
| CN | 107355069 | A | * | 11/2017 | E04G 5/001 |
| CN | 206769357 | U | * | 12/2017 | |
| CN | 206928628 | U | | 1/2018 | |
| CN | 206928632 | U | | 1/2018 | |
| CN | 108979121 | A | * | 12/2018 | E04G 5/001 |
| CN | 109372244 | A | | 2/2019 | |
| CN | 109457940 | A | * | 3/2019 | E04G 5/001 |
| CN | 109853934 | A | * | 6/2019 | |
| CN | 209179462 | U | | 7/2019 | |
| CN | 212317459 | U | * | 1/2021 | |
| CN | 216476250 | U | * | 5/2022 | |
| JP | 5798138 | B2 | | 10/2015 | |

* cited by examiner

SCAFFOLD ANTI-FALLING DEVICE

CROSS REFERENCE TO THE RELATED APPLICATIONS

This application is the national phase entry of International Application No. PCT/CN2019/079977, filed on Mar. 28, 2019, which is based upon and claims priority to Chinese Patent Application No. 201811412974.5, filed on Nov. 23, 2018, the entire contents of which are incorporated herein by reference.

TECHNICAL FIELD

The present invention relates to a safety guarantee structure for high-altitude operations, and more particularly, to a scaffold anti-falling device.

BACKGROUND

A lifting scaffold is installed on an exterior wall of a building for use. Since all application points of a scaffold body are located on the building structure, there is no need to construct the scaffold body from bottom to top, thus, it is more suitable for use in high-rise building construction. However, just because its application points are all located on the building structure, its ascending, descending, and stationary stability are all tightly related to a guide bearing base attached on the exterior wall, and it is necessary to install an anti-falling structure in such a guide bearing base. At present, the commonly used anti-falling structure cooperates with an anti-falling crosspiece on a guide rail through an anti-falling fork wheel. When the scaffold body falls, a ratchet wheel and a pawl installed coaxially with the anti-falling wheel form an engagement, so that the anti-falling fork wheel cannot rotate continuously and is then engaged with the anti-falling crosspiece on the guide rail, thereby preventing the scaffold body from continuing to fall. For the specific structure, please refer to the structure disclosed in a Chinese patent filed by the applicant of the present invention, and the publication number thereof is CN204299149U. However, such an anti-falling structure is more complicated and difficult in installation, and when the scaffold body does not fall, it is easy to damage the anti-falling fork or the anti-falling crosspiece on the guide rail because the ratchet wheel cannot timely reset, or because an end portion of the anti-falling fork abuts against the anti-falling crosspiece to be deadlocked. In addition, since the anti-falling fork and the anti-falling crosspiece are in line contact, a force area is small, the anti-falling fork is easily subjected to a relatively large impact and pressure during falling of the scaffold body, and this affects stability of use of the anti-falling in the guide bearing base. Thus, it is desirable to further study and improve this kind of anti-falling structure.

SUMMARY

In view of the above shortcomings, an objective of the present invention is to provide a scaffold anti-falling device, aimed to solve the problem that the similar anti-falling device in the prior art has a complicated structure and great difficulty in installation, is easily damaged in a use state due to deadlock, and has insufficient anti-falling stability and other technical problems.

In order to solve the above technical problems, the present invention adopts the following technical solutions.

The present invention provides a scaffold anti-falling device. The device includes a base body. A mounting shaft and a limiting block are fixed in the base body, and an anti-falling retaining arm is movably installed on the mounting shaft. A tail end of the anti-falling retaining arm corresponds to the limiting block, and the anti-falling retaining arm is limited by the limiting block when the anti-falling retaining arm is placed flat. A counterweight block is installed on the tail end of the anti-falling retaining arm, and the counterweight block drives to the anti-falling retaining arm to swing upward to reset. A trigger swing arm is movably installed in the base body, and the trigger swing arm is placed under the anti-falling retaining arm and forms an angle with the anti-falling retaining arm. The central axis of the mounting shaft includes a point O, and a distance between the point O and a point A is smaller than a distance between the point O and any point on a longitudinal section of an anti-falling crosspiece. The point A is an intersection point of an extension straight line of the lowest point on the bottom of the longitudinal section of the anti-falling crosspiece and an extension straight line of the outermost side point of a side adjacent to the bottom of the longitudinal section of the anti-falling crosspiece.

Preferably, as an improved technical solution, the bottom of the anti-falling crosspiece is a flat surface, or an approximately flat surface.

As an improved technical solution, a shape of the longitudinal section of the anti-falling crosspiece is any one of a T-shape, an L-shape, a triangle, a rectangle, a curved surface, a trapezoid, a fold-line shape, and a polygon having more than four sides.

As an improved technical solution, a plurality of anti-falling crosspieces are arranged, and are all installed on an anti-falling guide rail, and a distance between each two adjacent anti-falling crosspieces is equal.

As an improved technical solution, the upper portion of the anti-falling retaining arm and the bottom of the anti-falling crosspiece are flat surfaces corresponding to each other.

As an improved technical solution, a longitudinal section of the limiting block is in a transverse T-shape, and the front end and the rear end of the limiting block limit the position of the upper swinging and the position of the lower swinging of the anti-falling retaining arm on the mounting shaft, respectively.

As an improved technical solution, the counterweight block is detachably installed on the tail end of the anti-falling retaining arm.

As an improved technical solution, a side of the anti-falling retaining arm is provided with a contact surface, and a tail end of the trigger swing arm abuts against the contact surface. The maximum angle between the anti-falling retaining arm and the trigger swing arm is limited by the contact surface.

As an improved technical solution, the anti-falling retaining arm and the trigger swing arm are both installed on the mounting shaft.

As an improved technical solution, the trigger swing arm is installed on the anti-falling retaining arm through a rotation shaft.

Compared with the prior art, the present invention has the following advantages. The anti-falling retaining arm and the trigger swing arm are installed in the base body, and a distance between the point O on the mounting shaft of the anti-falling retaining arm and the point A on the anti-falling crosspiece is minimized. In this way, when the anti-falling crosspiece normally ascends or descends, the anti-falling retaining arm is quickly separated from the anti-falling crosspiece after all the contact points between the anti-falling retaining arm and the anti-falling crosspiece pass through the point A, thereby preventing deadlock due to the conflict between the anti-falling retaining arm and the anti-falling crosspiece. When a scaffold body falls, the anti-falling crosspiece quickly moves downward, and under the action of the movement of the anti-falling crosspiece, the trigger swing arm matched with the anti-falling retaining arm drives the anti-falling retaining arm to swing downward. The anti-falling retaining arm rotates downward, does not timely reset, and is immediately engaged with the next anti-falling crosspiece, thereby preventing the scaffold body from continuing to fall. Moreover, the anti-falling retaining arm and the anti-falling crosspiece are in surface contact, which effectively improves the stability of the scaffold anti-falling device and the safety of use of the lifting scaffold. The scaffold anti-falling device provided by the present invention is simple in structure and convenient in installation, has a low cost in use, and thus is suitable for being installed on various specifications of the lifting scaffolds or similar equipment for anti-falling, and the scope of application thereof is wide.

In the figures: 1. base body; 2. mounting shaft; 3. limiting block: 4. anti-falling retaining arm; 5. counterweight block; 6. trigger swing arm; 7. anti-falling crosspiece; 8. anti-falling guide rail; 9. rotation shaft; and 10. contact surface.

DETAILED DESCRIPTION OF THE EMBODIMENTS

The present invention will be further illustrated below with reference to the drawings.

Figure 1:
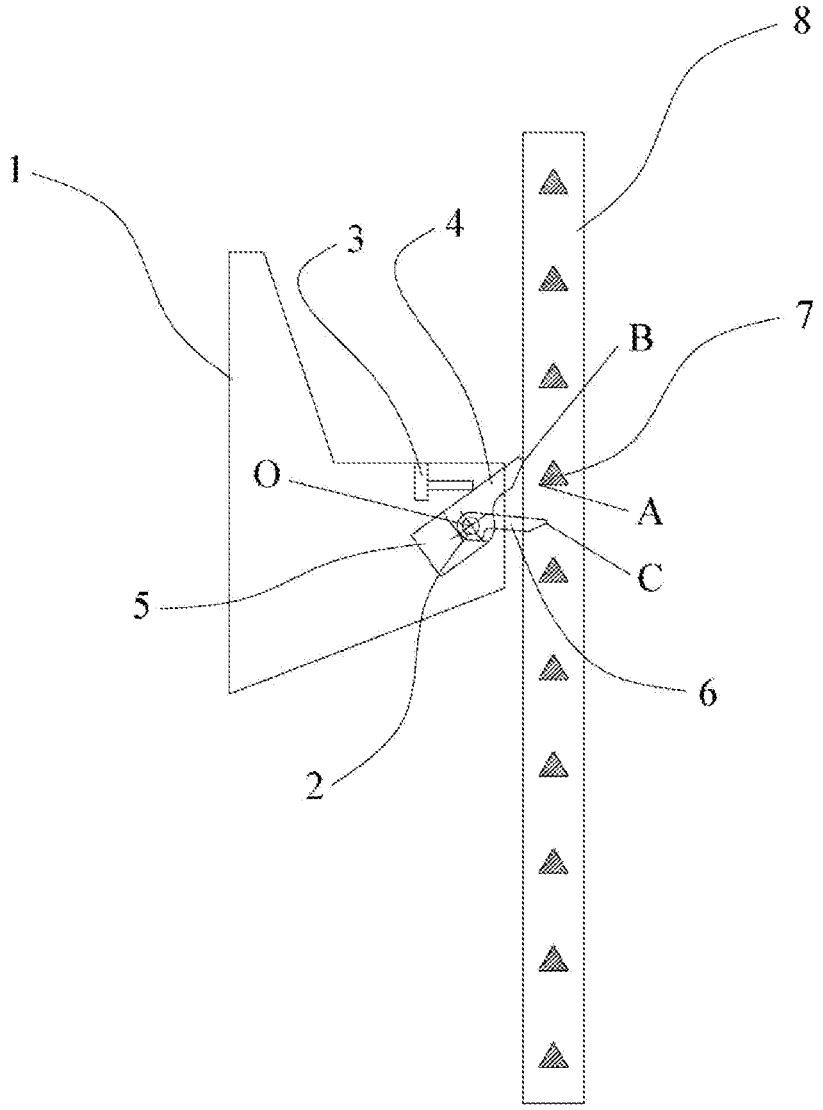
FIG. 1 is a schematic diagram of a structure of an embodiment of the present invention.

Referring to FIG. 1, an embodiment of the present invention provides a scaffold anti-falling device. The device includes the base body 1. One mounting shaft 2 and a set of limiting blocks 3 are fixed in the base body 1, and one anti-falling retaining arm 4 is movably installed on the mounting shaft 2, so that the anti-falling retaining arm 4 can swing up and down on the mounting shaft 2. Moreover, it is necessary to enable a tail end of the anti-falling retaining arm 4 to correspond to the limiting blocks 3, so that the limiting blocks 3 at least limit the anti-falling retaining arm 4 when the anti-falling retaining arm 4 is placed flat. Then, one counterweight block 5 is installed at the tail end of the anti-falling retaining arm 4, so that the anti-falling retaining arm 4 swings upward to reset due to the downward gravity of the counterweight block 5. As shown in FIG. 1, the trigger swing arm 6 is further movably installed in the base body 1, and the trigger swing arm 6 can still swing up and down, Meanwhile, the trigger swing arm 6 also needs to be placed under the anti-falling retaining arm 4, and forms an angle with the anti-falling retaining arm 4.

Based on the above-described structure in the present embodiment, the more important improvement made by the inventors during the design is a fit mode between the scaffold anti-falling device and the anti-falling crosspiece 7 when in use, and it is specifically described as follows.

Referring to FIG. 1, a point on the central axis of the mounting shaft 2 is set as the point O, and an end portion of the anti-falling retaining arm 4 is set as the point B, so that a distance between the point O and the point A is smaller than a distance between the point O and any point on a longitudinal section of the anti-falling crosspiece 7. The aforementioned point A is an intersection point of an extension straight line of the lowest point on the bottom of the longitudinal section of the anti-falling crosspiece 7 and an extension straight line of the outermost side point of a side adjacent to the bottom of the longitudinal section of the anti-falling crosspiece 7.

Figure 2:
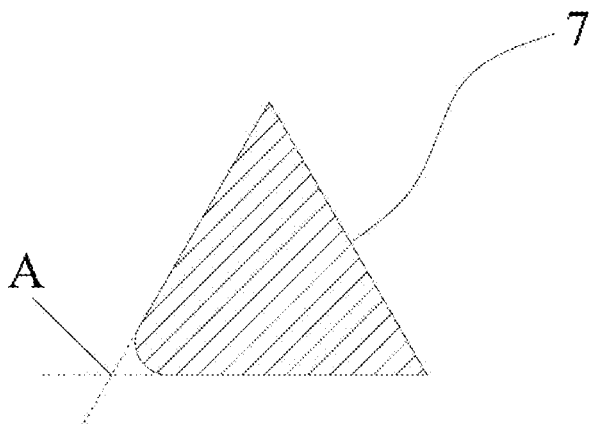
FIG. 2 is a schematic diagram of a first structure of an anti-falling crosspiece according to an embodiment of the present invention.
Figure 3:
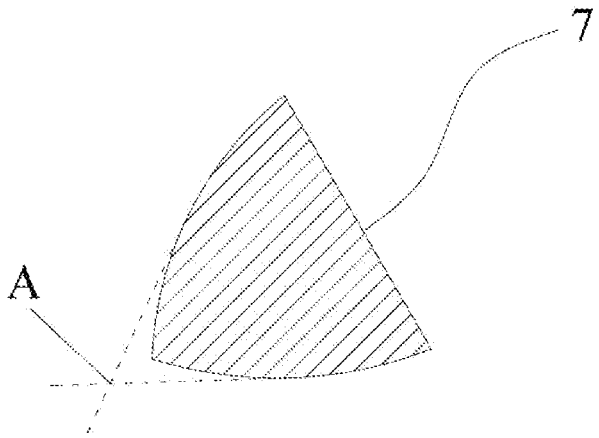
FIG. 3 is a schematic diagram of a second structure of the anti-falling crosspiece according to an embodiment of the present invention.

Based on the above definition of the point A, it can be known that the point A can be located on the longitudinal section of the anti-falling crosspiece 7 as shown in FIG. 1, and can also be located between the point O and the anti-falling crosspiece 7 as shown in FIGS. 2 and 3. In other words, when the bottom and adjacent side surfaces of the longitudinal section of the anti-falling crosspiece 7 are regular flat surfaces, the point A is located on the longitudinal section of the anti-falling crosspiece 7, otherwise, the point A is a virtual point located between the point O and the anti-falling crosspiece 7. Based on the aforementioned principle, different shapes of the anti-falling crosspiece 7 can be referred to as different embodiments of the present invention. For example, the longitudinal section of the anti-falling crosspiece 7 can be set as a T-shape, an L-shape, a triangle, a rectangle, a curved surface, a trapezoid, a fold-line shape, a polygon having more than four sides, and others.

Thus, in a structural design, the straight-line distance between the point A and the point O is smaller than the distance between the point O and any point on the longitudinal section of the anti-falling crosspiece 7, while the point O is required to be located on the same vertical plane as the points B and A. In the present embodiment, the point A, the point O, as well as other contact points between the anti-falling crosspiece 7 and the anti-falling retaining arm 4 are all located on an identical vertical plane.

According to the aforementioned principle, the bottom of the anti-falling crosspiece 7 can be directly designed as a flat surface or an approximately flat surface, such as a concave arc surface or convex arc surface with a relatively small arc, an irregular surface with a relatively small fluctuation, and others.

In the present embodiment, the anti-falling retaining arm 4 and the trigger swing arm 6 are installed in the base body, and a distance between the point O on the anti-falling retaining arm 4 and the point A on the anti-falling crosspiece 7 is minimized. In this way, when the anti-falling crosspiece 7 normally ascends or descends, the anti-falling retaining arm 4 is quickly separated from the anti-falling crosspiece 7 after all the contact points between the anti-falling retaining arm 4 and the anti-falling crosspiece 7 pass through the point A, thereby preventing deadlock due to the conflict between the anti-falling retaining arm 4 and the anti-falling crosspiece 7. When a scaffold body falls, the anti-falling crosspiece 7 quickly moves downward, and under the action of the movement of the anti-falling crosspiece 7, the trigger swing arm 6 matched with the anti-falling retaining arm 4 drives the anti-falling retaining arm 4 to swing downward. The anti-falling retaining arm 4 rotates downward, does not timely reset, and is immediately engaged with the next anti-falling crosspiece 7, thereby preventing the scaffold body from continuing to fall. Moreover, the anti-falling retaining arm 4 and the anti-falling crosspiece 7 are in surface contact, which effectively improves the stability of the scaffold anti-falling device and the safety of use of the lifting scaffold. Such a structure is simple in installation, has a low cost in use, and thus is suitable for being installed on various specifications of the lifting scaffolds or similar equipment for anti-falling, and the scope of application thereof is wide.

As mentioned above, when the bottom and adjacent side surfaces of the anti-falling crosspiece 7 are all regular flat surfaces, the point A is located on the longitudinal section of the anti-falling crosspiece 7. Therefore, the preferable shape of the longitudinal section of the anti-falling crosspiece 7 is an outer outline shaped as an equilateral triangle. In addition, the anti-falling crosspiece 7 adopts a cylindrical or tubular structure with an identical size in a vertical direction, and exactly, the longitudinal sections at any two positions of the anti-falling crosspiece 7 are completely identical.

Figure 4:
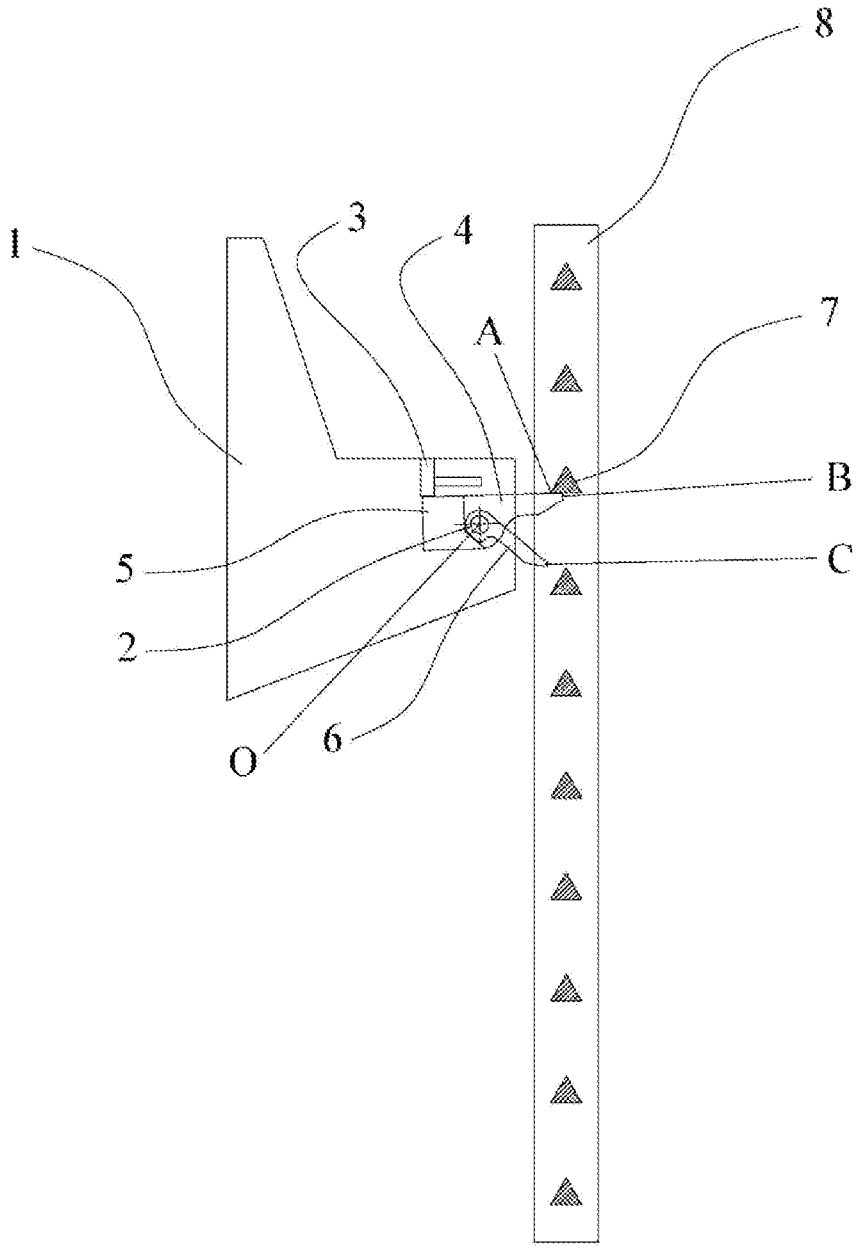
FIG. 4 is a schematic diagram of the structure in another state of FIG. 1.

Furthermore, as mentioned above, the structure disclosed in the present invention does not have the line contact of the similar components in the prior art between the anti-falling crosspiece 7 and the anti-falling retaining arm 4, but employs a manner of surface contact, so as to improve stability after the anti-falling engagement, and reduce the impact of falling of the scaffold body to the anti-falling device. Therefore, in the present embodiment, as shown in FIG. 4, preferably, the upper portion of the anti-falling retaining arm 4 and the bottom of the anti-falling crosspiece 7 are designed as the flat surfaces corresponding to each other, so as to increase a contact surface area between the anti-falling retaining arm 4 and the anti-falling crosspiece 7, thereby reducing the impact and pressure to the anti-falling retaining arm 4 during falling of the scaffold body. Moreover, when in use, a plurality of anti-falling crosspieces 7 are arranged in the above structure, and are all installed on the anti-falling guide rail 8. In addition, the distance between each two adjacent anti-falling crosspieces 7 is equal, and each anti-falling crosspiece 7 and the anti-falling retaining arm 4 can form the aforementioned correspondence relationship of the points A and O.

Referring to FIG. 1, in a preferred embodiment for resolving the technical problem according to the present invention, the inventors further discover in the experiments that when the anti-falling retaining arm 4 swings upward excessively, the downward swinging of the anti-falling retaining arm 4 will be affected, and to a certain extent, it is still easy to cause the anti-falling crosspiece 7 and the anti-falling retaining arm 4 to be deadlocked in a normal state. Thus, the limiting block 3 can be designed as a structure of which a longitudinal section is in a transverse T-shape as shown in FIG. 1, so that the front end and the rear end of the limiting block 3 can limit the position of the upper swinging and the position of the lower swinging of the anti-falling retaining arm 4 on the mounting shaft 2, respectively. Furthermore, in order for easy replacement of counterweight blocks 5 with different weights, it is unnecessary for the counterweight block 5 to be integrated with the anti-falling retaining arm 4, and it is allowable that the counterweight block 5 is detachably installed on the tail end of the anti-falling retaining arm 4 by a bolt, a pin shaft, a snap-fit structure or the like.

Figure 5:
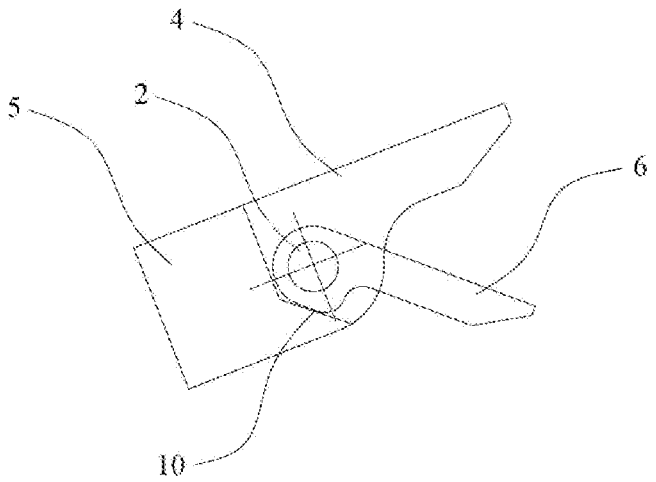
FIG. 5 is an enlarged view of a structure formed by an anti-falling retaining arm and a trigger swing arm in FIGS. 1 and 4.

Referring to FIG. 5, according to an embodiment of the present invention, in the anti-falling device, when the anti-falling crosspiece 7 moves up and down normally, the trigger swing arm 6 is toggled by the anti-falling crosspiece 7, so that the trigger swing arm 6 drives the anti-falling retaining arm 4 to swing up and down. Thus, if a maximum angle between the anti-falling retaining arm 4 and the trigger swing arm 6 is not limited, then the normal cooperation between the trigger swing arm 6 and the anti-falling retaining arm 4 is easily affected. In the present embodiment, the maximum angle between the anti-falling retaining arm 4 and the trigger swing arm 6 is limited by means of engagement of the contact surface 10. Specifically, a side of the anti-falling retaining arm 4 is provided with one contact surface 10, and then a tail end of the trigger swing arm 6 abuts against the contact surface 10, so that the maximum angle between the anti-falling retaining arm 4 and the trigger swing arm 6 is limited by the contact surface 10. The engaging and limiting structure of the contact surface 10 has the improved impact resistance and the relatively large force area in comparison with other limiting structures, and is conducive to improving the stability of use of the anti-falling device.

Figure 6:
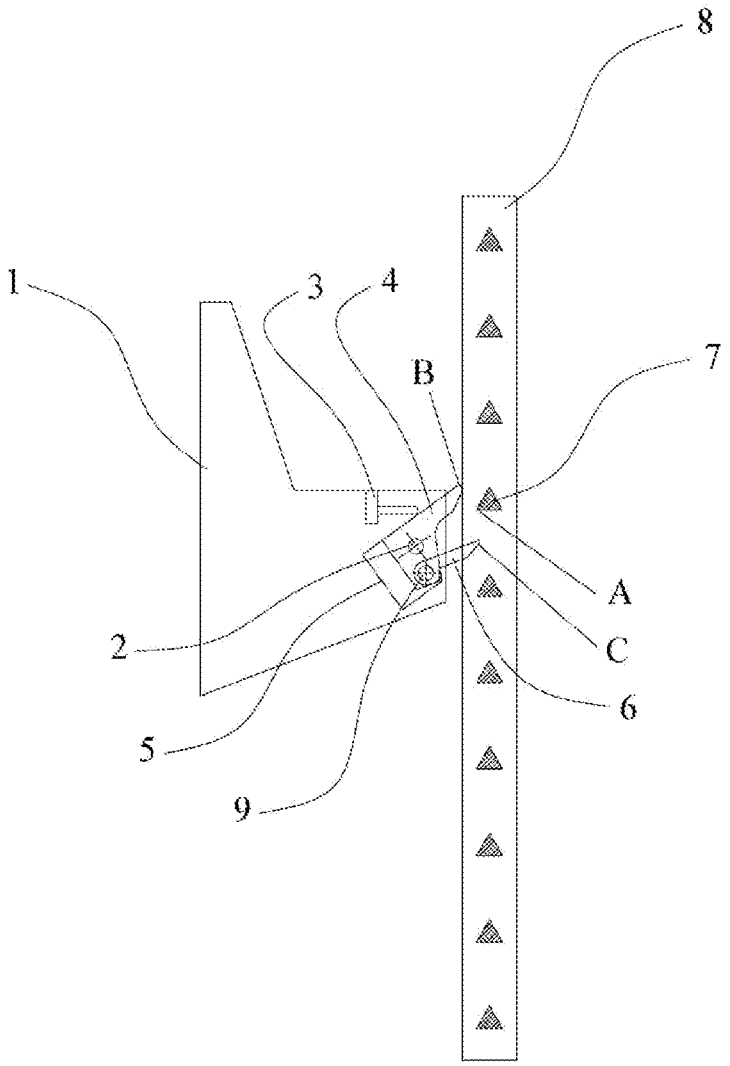
FIG. 6 is a schematic diagram of a structure of another embodiment of the present invention.

Furthermore, since the trigger swing arm 6 needs to follow the anti-falling retaining arm 4 to swing up and down, there are not many restrictions on the installation manner of the trigger swing arm 6 as long as it can satisfy the above functions. In view of this, the inventors provide two manners, one is as shown in FIG. 1, in which both the anti-falling retaining arm 4 and the trigger swing arm 6 are installed on the mounting shaft 2; and the other one is as shown in FIG. 6, in which the trigger swing arm 6 is installed on the anti-falling retaining arm 4 through the rotation shaft 9. Here, it needs to be noted that in this manner, the rotation shaft 9 is not installed on the base body 1, but is installed on the anti-falling retaining arm 4.

Referring to FIGS. 1 and 4, when the above preferred embodiments of the present invention are in actual use, in a normal state, under the gravity of the counterweight block 5, the front end of the anti-falling retaining arm 4 retains tilted upward, and the front end of the trigger swing arm 6 is placed between the two adjacent anti-falling crosspieces 7.

In addition, the counterweight block 5 is configured to enable the anti-falling retaining arm 4 to timely reset after the anti-falling retaining arm 4 swings downward. Based on this technical objective, the counterweight block 5 can be replaced with a spring, so that the anti-falling retaining arm 4 can reset under the action of a tensile force or an elastic force of the spring after the anti-falling retaining arm 4 swings downward. It is taken as an example that the counterweight block 5 is installed on the tail end of the anti-falling retaining arm 4, and the use principle of the anti-falling device is explained as follows.

In an ascending process of the scaffold body: in the normal state, the anti-falling retaining arm 4 is tilted upward under the gravity of the counterweight block 5, the scaffold body ascends under the action of a power unit. During this process, the horizontal distance between the point O and the point B is smaller than the horizontal distance between the point O and the point A, and the anti-falling retaining arm 4 is not in contact with the anti-falling crosspiece 7. Since the front end of the trigger swing arm 6 is placed between two adjacent anti-falling crosspieces 7, the trigger swing arm 6 is toggled during an ascending process of the anti-falling crosspiece. During this process, the anti-falling retaining arm 4 remains stationary, and the trigger swing arm 6 avoids the anti-falling crosspiece 7 in the ascending process by reducing the angle with the anti-falling retaining arm 4. After the current anti-falling crosspiece 7 passes, the trigger swing arm 6 resets under its own gravity and remains the maximum angle with the anti-falling retaining arm 4.

In a descending process of the scaffold body: an end portion of the trigger swing arm 6 is set as the point C, and in the normal state, the anti-falling retaining arm 4 is tilted upward under the gravity of the counterweight block 5. During this process, the horizontal distance between the point O and the point B is smaller than the horizontal distance between the point O and the point A, and the horizontal distance between the point O and the point A is smaller than the horizontal distance between the point O and the point C. When the anti-falling crosspiece 7 slowly moves downward, the trigger swing arm 6 is toggled downward to further drive the anti-falling retaining arm 4 to swing downward. Since the downward swinging distance of the trigger swing arm 6 is smaller than a distance between two adjacent anti-falling crosspieces 7 on the anti-falling guide rail 8, the trigger swing arm 6 and the anti-falling retaining arm 4 swing upward to reset under the action of the counterweight block 5 after the current anti-falling crosspiece 7 passes the trigger swing arm 6, and the trigger swing arm 6 is separated from the anti-falling crosspiece 7 at this time. In other words, under the action of the counterweight block 5, the anti-falling retaining arm 4 drives the trigger swing arm 6 to swing away from the anti-falling crosspiece 7. The above actions are repeated when the next anti-falling crosspiece 7 arrives at the position of the trigger swing arm 6.

A principle of anti-falling of the scaffold body is as follows. It has been described above that the trigger swing arm 6 and the anti-falling retaining arm 4 swing upward to reset under the action of the counterweight block 5 after the current anti-falling crosspiece 7 passes the trigger swing arm 6, and during this process, a descending speed of the anti-falling crosspiece 7 is required to be smaller than a speed of resetting of the trigger swing arm 6 and the anti-falling retaining arm 4. When the scaffold body falls, the descending speed of the anti-falling crosspiece 7 is much larger than the speed of resetting of the trigger swing arm 6 and the anti-falling retaining arm 4, that is, the anti-falling retaining arm 4 does not timely reset and is immediately engaged with the next anti-falling crosspiece 7 to prevent the scaffold body from continuing to fall, such as a state shown in FIG. 4. At this time, the horizontal distance between the point O and the point B is larger than the horizontal distance between the point O and the point A, and the anti-falling retaining arm 4 and the anti-falling crosspiece 7 form surface contact.

"An/one embodiment", "another embodiment", "embodiment" and the like, discussed in this specification, refer to that the specific features, structures or characteristics described in conjunction with the embodiment are contained in at least one embodiment described generally in the present application. The same expression appearing in multiple places in the specification does not necessarily refer to the same embodiment. Furthermore, when a specific feature, structure or characteristic is described in conjunction with any embodiment, what is claimed is that the implementation of this feature, structure or characteristic in conjunction with other embodiment also falls within the scope of the present invention.

Although the present invention is described by referring to a plurality of exemplary embodiments of the present invention here, it should be understood that those skilled in the art may design many other modifications and embodiments, and these modifications and embodiments shall fall within the principle, scope and spirit disclosed by the present application. Specifically, various modifications and improvements may be made to the component parts and/or the layout for the combination layout of subject matter of the present application within the scope of the disclosure, drawings, and claims of the present application. In addition to the modifications and improvements made on the component parts and/or the layout, other uses will also be obvious to those skilled in the art.

What is claimed is:

1. A scaffold anti-falling device, comprising a base body; wherein a mounting shaft and a limiting block are fixed in the base body, and an anti-falling retaining arm is movably installed on the mounting shaft;

a tail end of the anti-falling retaining arm aligns with and is limited in position by the limiting block when the anti-falling retaining arm is placed flat;

a counterweight block is installed on the tail end of the anti-falling retaining arm, and the counterweight block drives to the anti-falling retaining arm to swing upward to reset;

a trigger swing arm is movably installed in the base body, and the trigger swing arm is placed under the anti-falling retaining arm and forms an angle with the anti-falling retaining arm;

a central axis of the mounting shaft comprises a first point, and a distance between the first point and a second point is smaller than a distance between the first point and any point on a cross-section of an anti-falling crosspiece on the scaffold anti-falling device, and the second point is an intersection point of an extension straight line of a lowest point on a bottom of the cross-section of the anti-falling crosspiece and an extension straight line of an outermost side point of a side adjacent to the bottom of the cross-section of the anti-falling crosspiece, wherein a bottom of the anti-falling crosspiece is a flat surface, or an approximately flat surface, the counterweight block is detachably installed on the tail end of the anti-falling retaining arm, a side of the anti-falling retaining arm includes a contact surface, and a tail end of the trigger swing arm abuts the contact surface such that the contact surface limits a maximum angle between the anti-falling retaining arm and the trigger swing arm, and the trigger swing arm is installed on the anti-falling retaining arm through a rotation shaft.

2. The scaffold anti-falling device of claim 1, wherein a shape of the cross-section of the anti-falling crosspiece is a triangle.

3. The scaffold anti-falling device of claim 1, wherein a plurality of anti-falling crosspieces are installed on an anti-falling guide rail, and a distance between each two adjacent anti-falling crosspieces of the plurality of anti-falling crosspieces is equal.

4. The scaffold anti-falling device of claim 1, wherein an upper portion of the anti-falling retaining arm and a bottom of the anti-falling crosspiece are flat surfaces corresponding to each other.

5. The scaffold anti-falling device of claim 1, wherein a cross-section of the limiting block is in a transverse T-shape, and a front end and a rear end of the limiting block limit a position of an upper swing and a position of a lower swing of the anti-falling retaining arm on the mounting shaft, respectively.

* * * * *